US008414780B2

(12) United States Patent
Kowoll et al.

(10) Patent No.: US 8,414,780 B2
(45) Date of Patent: Apr. 9, 2013

(54) METHOD AND SYSTEM FOR REMOVING SLAG, PARTICULARLY SLAG THAT OCCURS DURING SYNTHESIS GAS EXTRACTION, FROM A SLAG BATH CONTAINER

(75) Inventors: Johannes Kowoll, Bochum (DE); Eberhard Kuske, Soest (DE)

(73) Assignee: ThyssenKrupp Uhde GmbH, Dortmund (DE)

( * ) Notice: Subject to any disclaimer, the term of this patent is extended or adjusted under 35 U.S.C. 154(b) by 0 days.

(21) Appl. No.: 12/735,461

(22) PCT Filed: Jan. 21, 2009

(86) PCT No.: PCT/EP2009/000350

§ 371 (c)(1),
(2), (4) Date: Jan. 21, 2009

(87) PCT Pub. No.: WO2009/092569

PCT Pub. Date: Jul. 30, 2009

(65) Prior Publication Data

US 2010/0288711 A1 Nov. 18, 2010

(30) Foreign Application Priority Data

Jan. 24, 2008 (DE) ..... 10 2008 005 704

(51) Int. Cl.

| | |
|---|---|
| ***B01D 35/18*** | (2006.01) |
| ***C02F 1/00*** | (2006.01) |
| *B01D 43/00* | (2006.01) |
| *C01B 3/36* | (2006.01) |
| *C10J 3/46* | (2006.01) |
| *C10J 3/54* | (2006.01) |
| *C10J 3/00* | (2006.01) |

(52) U.S. Cl. ..... 210/774; 210/808; 48/197 R; 48/206; 48/210

(58) Field of Classification Search ..... 210/153, 210/768, 774, 808; 48/197 R, 206, 210
See application file for complete search history.

(56) References Cited

U.S. PATENT DOCUMENTS

| | | | | |
|---|---|---|---|---|
| 3,994,702 | A * | 11/1976 | Schweimanns et al. | 48/197 R |
| 4,094,470 | A | 6/1978 | Waldhofer | |
| 4,381,924 | A * | 5/1983 | Schmidt et al. | 48/197 R |
| 4,425,139 | A | 1/1984 | Schmidt et al. | |
| 4,465,496 | A * | 8/1984 | Suggitt | 48/197 R |
| 4,576,712 | A | 3/1986 | Greenwood | |
| 4,852,997 | A * | 8/1989 | Segerstrom et al. | 48/210 |
| 5,647,876 | A * | 7/1997 | Winter et al. | 48/197 R |
| 6,755,980 | B1 * | 6/2004 | Van Den Born et al. | 210/767 |
| 2008/0209807 | A1 * | 9/2008 | Tsangaris et al. | 48/89 |

FOREIGN PATENT DOCUMENTS

| | | | |
|---|---|---|---|
| CA | 1336645 C | * | 8/1995 |
| DE | 24 55 127 | | 6/1976 |

(Continued)

OTHER PUBLICATIONS

International Search Report, Oct. 12, 2009.

*Primary Examiner* — Bobby Ramdhanie
*Assistant Examiner* — Clare Perrin
(74) *Attorney, Agent, or Firm* — Collard & Roe, P.C.

(57) ABSTRACT

With a method for removing slag, particularly slag that occurs during synthesis gas extraction, from a slag bath situated in a pressurized container, into a collection container for the slag, below the slag bath in the direction of gravity, a device for breaking up the slag is provided below the slag bath, and a sluice valve is provided between the containers. A space filled with a gas bubble, which space stands in contact with the liquid in the containers, particularly a ring space or a separate container, is provided, in which the pressure of the gas bubble is regulated by supplying gas. At least a part of the water situated in the slag sluice/collection space flows through the slag bath valve when the latter is opened, in the direction of the slag bath, counter to the direction of gravity.

1 Claim, 2 Drawing Sheets

FOREIGN PATENT DOCUMENTS

| | | |
|---|---|---|
| DE | 26 06 039 | 8/1977 |
| DE | 28 29 629 | 1/1980 |
| DE | 31 44 266 | 7/1982 |
| DE | 600 31 875 | 4/2007 |
| EP | 0 113 469 | 7/1984 |
| EP | 0 290 087 | 11/1988 |
| GB | 2 026 145 | 1/1980 |
| WO | WO 01/21736 | 3/2001 |

* cited by examiner

METHOD AND SYSTEM FOR REMOVING SLAG, PARTICULARLY SLAG THAT OCCURS DURING SYNTHESIS GAS EXTRACTION, FROM A SLAG BATH CONTAINER

CROSS REFERENCE TO RELATED APPLICATIONS

This application is the National Stage of PCT/EP2009/000350 filed on Jan. 21, 2009, which claims priority under 35 U.S.C. §119 of German Application No. 10 2008 005 704.5 filed on Jan. 24, 2008. The international application under PCT article 21(2) was not published in English.

The invention is directed at a method for removing slag, particularly slag that occurs during synthesis gas extraction, from a slag bath situated in a pressurized container, into a collection container for the slag, below the slag bath in the direction of gravity, whereby a device for breaking up the slag is provided below the slag bath, if necessary, and a sluice valve is provided between the containers, as well as at a system for carrying out this method.

Particularly in the production of synthesis gas, slag occurs in the partial combustion of fuels that contain carbon, and this slag is quenched and cooled in a water reservoir. In this connection, it is also known to break up overly large slag pieces in this quenching bath, by means of corresponding devices. With regard to the state of the art, here the references DE 26 06 039-A1, DE 28 29 629 C2, DE 31 44 266-A1, DE 600 31 875 T2, EP 0 290 087 A2, EP 0 113 469 B1, or U.S. Pat. No. 4,852,997 should be particularly mentioned.

In order to improve the removal of the slag, i.e. the flow through the corresponding sluice regions, it is known to pump water low in solids from a collection container that lies downstream in the system, and is generally disposed below the other containers, in the direction of gravity, into the container situated above it, in order to thereby improve the flow through the bottlenecks or a valve at its opening. This flow formation between the downstream container and the container that lies upstream can take place by means of pumping, for example, as shown in DE-600 31 875-T2 or described in DE-31 44 266-A1. However, it can also be brought about by means of a partial vacuum gas bubble in the head region of the downstream container, as described in EP-0 290 087-A2, which draws the water/slag stream through the valve regions, increasing the flow speed, with the gas bubble and the partial vacuum.

Aside from the problems of slag becoming lodged in constrictions or in the valve region, another problem consists in that environmentally burdensome vapors can escape from the system.

This is where the invention takes its start; its task consists in clearly improving the corresponding methods of procedure and systems of the types in question, improving the slag removal and avoiding environmentally burdensome vapors or waste gases.

With a method of the type indicated initially, this task is accomplished, according to the invention, in that a space filled with a gas bubble, which space stands in contact with the liquid in the containers, particularly a ring space or a separate container, is provided, in which the pressure of the gas bubble is regulated by means of supplying gas, in such a manner that at least a part of the water situated in the slag sluice/collection space flows through the slag bath sluice valve when the latter is opened, in the direction of the slag bath, counter to the direction of gravity.

It has been shown that bridges of compressed, wedged slag or large particles that might occur can be loosened by means of a short, for example lasting a few seconds, intensive gas or water counter-stream through the upper sluice valve, in order to ensure optimal flow through the valve.

Other improvements of the flow through the valve result, for example, from the fact that installations are assigned to the slag sluice/collection container, with which the slag/water flow is changed.

Depending on the process conditions, it is possible that temperatures lie in the saturation range, for example at 200° C., in the first container that forms the granulate of the slag, which temperatures lead to significant vapor formation at the end of the system, with little cooling, and that this should be avoided, as has already been indicated above.

Here, the invention provides, in an embodiment, that following the constriction, a narrowed flow channel, in which the slag/water stream is cooled, is provided, and/or that a counter-stream against the slag stream is produced in the slag collection/sluice container, by means of feeding in colder water. A tangential or secantial feed of the water is advantageous, in order to generate spin and improve the cooling effect.

A particularly advantageous method of procedure, particularly at the end of the slag treatment path, consists in adjusting the temperature by means of feeding in fresh water, and after the desired temperature is reached, opening an outlet valve, in order to empty the slag collection/sluice container, and passing the water/slag mixture to an encapsulated settling pan or the like, whereby the encapsulated settling pan is equipped with devices for removing the settled slag and with devices for drawing off vapors.

The task stated above is accomplished with a system that consists of a slag bath container with a device for breaking up the slag that is formed, if necessary, to which a sluice is assigned at the bottom, in the direction of gravity, which sluice stands in connection with a slag collection/sluice container, and which is characterized in that an accommodation space for a gas bubble is provided below the entry valve of the sluice, the pressure of which bubble can be controlled by way of a filling valve, and which bubble stands in an active connection with the liquid in the collection container.

Other embodiments of the system according to the invention are evident from the other dependent claims that relate to the system.

The invention will be explained in greater detail in the following, using the drawing, as an example. This shows, in

BRIEF DESCRIPTION OF THE DRAWINGS

With reference to FIG. 1, which shows only the region of a synthesis gas production system, which concerns itself with disposal of the slag, and which shows all the system elements schematically, this container for the slag bath provided is also shown in the drawing, along with the slag bath itself with quenching zone and collection space for the slag 1*a*.

Figure 1:
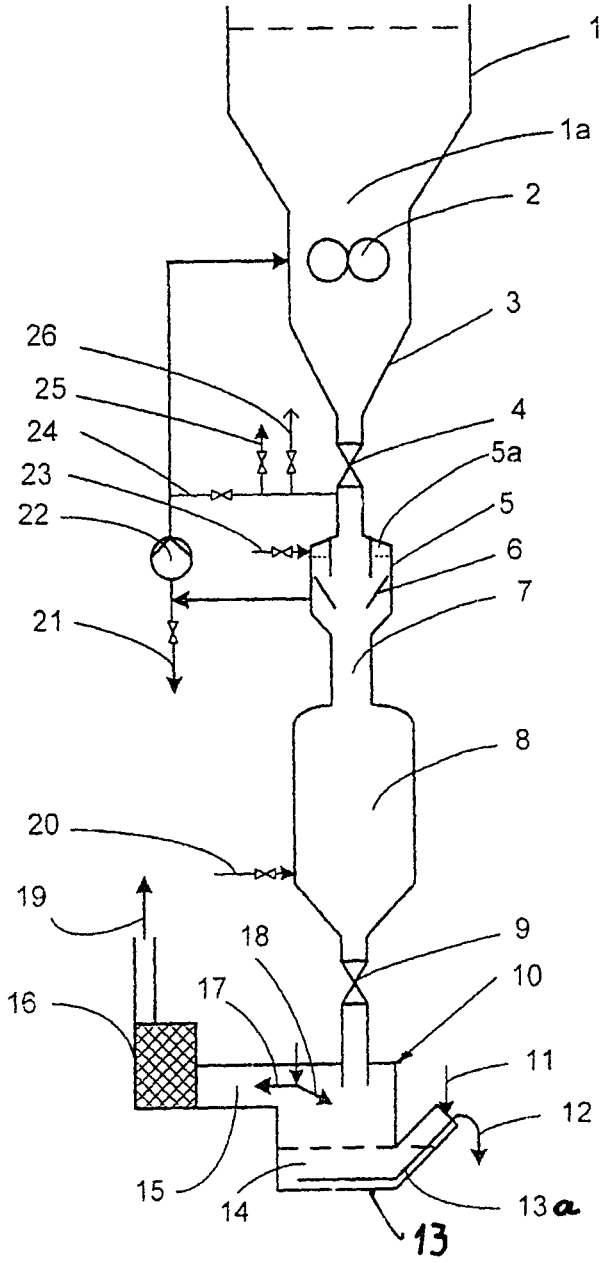
FIGS. 1 and 2 a simplified illustration of two embodiments of the invention, in each instance.

At 2, slag breakers are shown merely symbolically; these can be situated in a narrowing space of the slag bath container 1. Below these slag breakers, a constriction 3 leads to a sluice valve indicated with 4, which leads to a tubular element that in turn guides the slag/water stream into a separating container indicated with 5, when the valve 4 is opened, which container is equipped with a constriction 6 in order to facilitate slag separation.

As shown, a ring space filled with a gas bubble 5*a* occurs in this separating container 5, in the head region, the volume of which space can amount to maximally 20% of the sluice volume. The gas feed line into this ring space is indicated with 23.

As can be seen, the gas bubble 5*a* is in active contact with the liquid level in the separating container 5, whereby the gas pressure can be adjusted, by way of the line 23, in such a manner that such an excess pressure prevails that when the sluice 4 is opened, a sudden, short-term back-flow of the liquid mixture from the separating container 5 through the valve 4 into the funnel region 3 of the slag bath 1 occurs, and there loosens any wedged slag bridges that might be present.

In the example of FIG. 1, the separating container 5 is followed by a narrowed flow channel 7 that then is passed to a slag/sluice collection space 8, at the end of which an outlet valve 9 for passing out slag that has collected there is situated. The flow channel 7 and the container 8 can be equipped with external cooling coils to clearly cool the slag/water stream that flows through.

For further cooling, if necessary, a feed of cold water to this sluice container 8 can be provided, as indicated with 20 in FIG. 1, whereby a cooling, circumferential flow can be adjusted. A corresponding flow line is indicated with 21 in FIG. 1, which line can be connected with the line 20, if necessary, by way of a slag/water treatment not shown in any detail here, to form a ring flow.

The outward transfer valve 9 leads to an encapsulation, indicated with 10, of a slag accommodation pan 13, which can be equipped with a slag discharge device, for example a scratch conveyor 13*a*, whereby the slag discharge indicated with 12 can additionally have liquid applied to it, by way of a spray device 11, in order to prevent discharge of contaminants to the environment.

In order to be able to discharge the cooled vapors from the encapsulation 10, a vapor hood 15 is provided, which empties into a droplet precipitator 16, whereby at 17, a conveying device, for example a water-jet pump, is indicated, which can simultaneously be operated also with another spraying device 18, in order to spray the slag that comes in, which then settles in the pan, as indicated at 14. The air exit from the droplet precipitator 16 is indicated with 19.

The water-jet pump 17 and the spray device 18 require a large stream of water, which is similar in size to the slag/water stream out of the container 8 during emptying through the valve 9, for example 12 $m^3$ in two minutes, i.e. 0.1 $m^3/s$. In order to avoid a water supply with large dimensions (water line, pump, and others), water from a pressurized supply container 27 (indicated in FIG. 2) is used for the water-jet pump 17 and the spraying device 18 and optionally also for flushing 20 during the process of filling the container 8 with slag.

The excess pressure is produced using a pressure cushion. A higher pressure than that of the water bath is preferred, so that the water can first be used for flushing 20, under high pressure, and then for the water-jet pump 17 and the spraying device 18, during emptying of the container. A similar large water stream is also necessary for filling the empty container 8 in the pressure-free state. This water requirement can be covered by an inexpensive, pressure-free supply container that can be accommodated above the container 8 (not shown), in order to be able to transfer the water simply by using hydrostatic pressure. The two containers are supplied with water at a relatively small stream of water during the entire cycle, for example an hour. The supply container also makes possible the use of continuously occurring, i.e. treated and cooled process water.

In addition, FIG. 1 also shows the device for formation of a ring flow that supports the slag stream, with extraction of the liquid from the separating container 5, by way of a circulation pump 22, into the slag bath container 1, below the liquid level. At 24, a line for return of displaced water is indicated; at 25, a possible take-off line for the displaced water, depending on the feed of fresh water is indicated, for example by way of the line 20, whereby at 26, an exhaust air line is also indicated.

Figure 2:
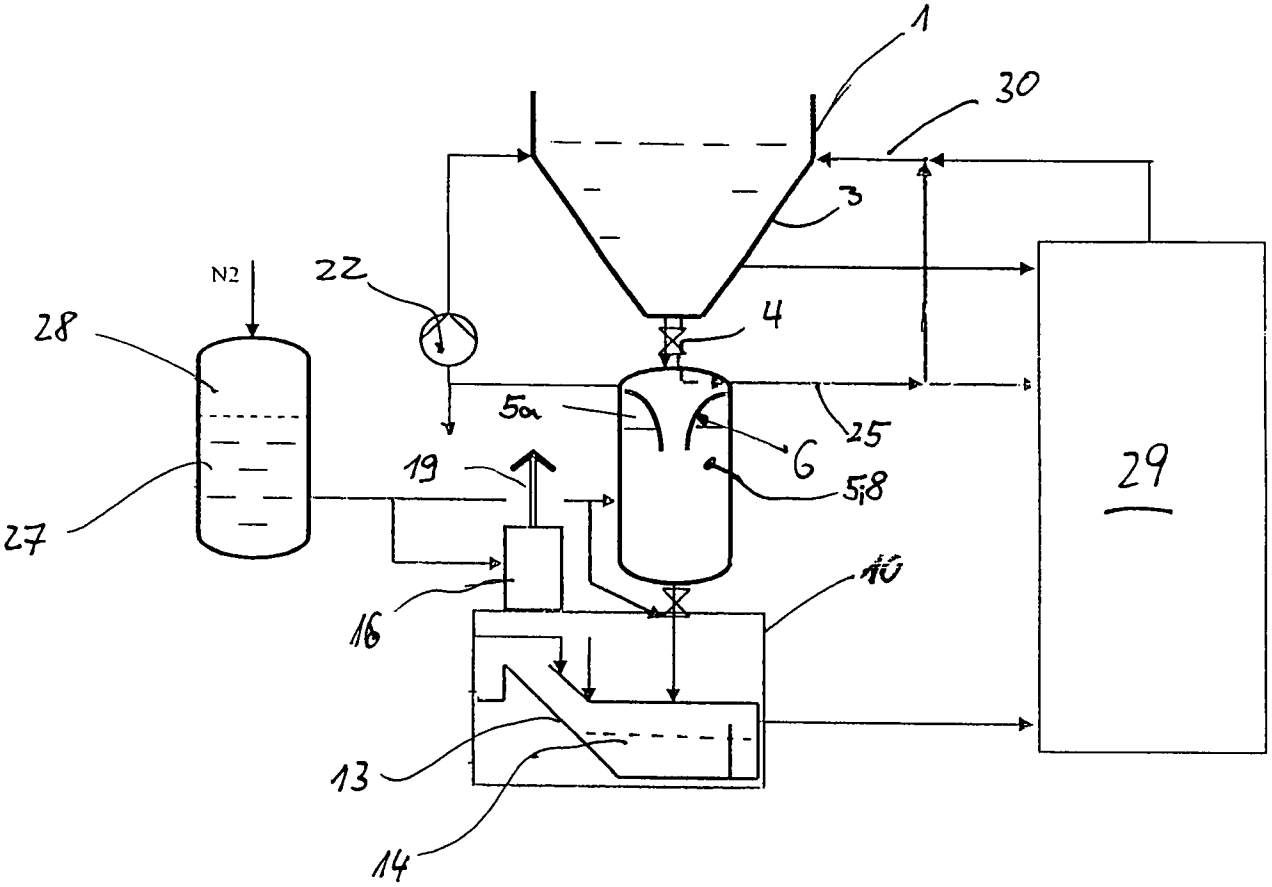

In FIG. 2, a slightly modified exemplary embodiment of the system is shown, whereby the elements that have the same effect carry the same reference symbols as in FIG. 1, but there, the separating container 5 with installations 6 and the slag/sluice collection space 8 are configured as a component, and indicated in FIG. 2 with 5, 8. This is a particularly good option if the slag bath can be operated at relatively low temperatures, so that intensive flushing over a cooling segment 7, for example, is not necessary.

In FIG. 2, some additional system parts are also shown, for example a fresh water supply container 27 that is equipped with a gas buffer 28, along with a slag/water treatment system, indicated in general with 29, to which slag/water can be supplied from the individual system parts, and this can be passed back to the slag bath container as a filtrate, by way of a line 30, if necessary.

Of course, the exemplary embodiments of the invention as described can be modified further in many different respects, without departing from the basic idea. Thus, the invention is particularly not restricted to a specific form of the individual components, also not to the type of slag breaker 2, the particular type of cooling of the cooling segment 7, or the treatment of the slag water, to mention only a few examples. In the example described in the figures, only one sluice is provided, for example for comparatively low slag throughput (for example 10 t/h). At a higher slag throughput (for example 40 t/h), two parallel sluices with all the components, i.e. from the valve 4 to the valve 9, can be provided in a double embodiment, for example.

The invention claimed is:

1. A method for removing slag that occurs during synthesis gas extraction, from a slag bath situated in a pressurized container, into a collection container for the slag, below the slag bath in the direction of gravity, comprising the following steps:

providing a device for breaking up the slag below the slag bath;

providing a sluice valve between the containers;

providing a space filled with a gas bubble under a regulative pressure, wherein the space stands in contact with a liquid in the containers;

assigning installations to the collection container for regulating a flow of a slag/water stream;

cooling the slag/water stream by providing a narrowed flow channel following the installations, counter to the direction of gravity;

producing a short, intensive counter-stream to counter the slag/water stream in the collection container to loosen any wedged slag bridges, by feeding in colder water, wherein the duration of the short, intensive counter-stream is a few seconds;

regulating the pressure of the gas bubble by supplying gas, in such a manner that at least a part of the water situated in the collection container flows through the sluice valve when the sluice valve is opened, in the direction of the slag bath;

providing a filling process at a temperature with fresh water, wherein during the filling process and before emptying the collection container, the temperature is adjusted by feed of the fresh water to a desired temperature, and after the desired temperature has been reached, an outlet valve is opened and the slag/water stream is passed to an encapsulated settling pan to produce settled slag that is equipped with devices for discharging the settled slag and with devices for drawing off vapors.

* * * * *

UNITED STATES PATENT AND TRADEMARK OFFICE

CERTIFICATE OF CORRECTION

PATENT NO. : 8,414,780 B2
APPLICATION NO. : 12/735461
DATED : April 9, 2013
INVENTOR(S) : Kowoll et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 345 days.

On the title page, Item [86], the §371 (c) (1) filing date should be changed from "Jan. 21, 2009" to correctly read: --Jul. 19, 2010--.

Signed and Sealed this
Eighteenth Day of June, 2013

Teresa Stanek Rea

Teresa Stanek Rea
*Acting Director of the United States Patent and Trademark Office*